United States Patent [19]

Pilch

[11] 4,078,680

[45] Mar. 14, 1978

[54] SWING MECHANISM FOR EARTHMOVING APPARATUS SUCH AS A BACKHOE

[75] Inventor: John S. Pilch, Ware, Mass.

[73] Assignee: Ware Machine Service, Inc., Ware, Mass.

[21] Appl. No.: 738,948

[22] Filed: Nov. 4, 1976

[51] Int. Cl.[2] ..... E02F 3/75

[52] U.S. Cl. ..... 214/138 E; 74/89.2

[58] Field of Search ..... 214/1 BC, 132, 138 C, 214/138 D, 138 E, 151; 212/66, 69; 74/89.2, 89.21, 89.22

[56] References Cited

U.S. PATENT DOCUMENTS

| | | | |
|---|---|---|---|
| 2,365,168 | 12/1944 | Billings | 212/69 |
| 3,033,380 | 5/1962 | Dorkins | 214/138 E X |
| 3,184,980 | 5/1965 | Schell | 212/66 X |
| 3,891,104 | 6/1975 | Pilch | 214/138 E |
| 3,894,641 | 7/1975 | Pilch | 214/138 E |
| 4,003,484 | 1/1977 | Jones et al. | 214/138 E |

FOREIGN PATENT DOCUMENTS

| | | | |
|---|---|---|---|
| 224,765 | 9/1959 | Australia | 214/138 E |

*Primary Examiner*—L. J. Paperner

*Attorney, Agent, or Firm*—Chapin, Neal and Dempsey

[57] ABSTRACT

Swing mechanism for a backhoe, crane or other earthmoving apparatus which includes a main frame, a rotatable turret supported by the frame, the drive mechanism includes a pair of hydraulic rams supported by the frame in partially coextensive lateral relationship. The drive strokes of said rams are generally in opposite directions. Associated with each ram, the drive mechanism includes a pivotable lever and an elongate flexible member connected to generally opposite points on the turret to rotate the turret in opposite direction. The flexible members extend from the pivotable levers in generally opposite directions to points of engagement with an arcuate member and then extend at least partially about the circumference of the arcuate member to their point of connection to the turret. The surface of the arcuate member engaged by said flexible members has different radial dimensions measured from its axis of rotation at circumferentially spaced locations about the periphery of the arcuate member whereby the angular or rotational velocity of said turret versus the linear velocity of the piston rods of the said rams is maintained at a predetermined ratio throughout a horizontal arc of movement of the turret.

12 Claims, 5 Drawing Figures

SWING MECHANISM FOR EARTHMOVING APPARATUS SUCH AS A BACKHOE

BACKGROUND OF THE INVENTION

Various types of swing mechanisms for earthmoving apparatus, including backhoes, cranes, derricks and the like, have been commercially available for many years and numerous of such mechanisms have been disclosed in the prior art for many years. Not only is the mechanical operating efficiency of such mechanism of importance, but also of concern is the configuration and relative size, since it is vital that the center of balance of the backhoe be as close as possible to the hauling tractor to which it is coupled. Thus the smaller the longitudinal displacement between the tractor hitch and the backhoe turret or boom support frame, the more advantageous the arrangement. Where the configuration is held to a minimum, improved tractor balance and stability both longitudinally and laterally results. The trend today has been toward the adaptation of large backhoes on small tractors and when this is done substantial counterweighting may be required. Such counterweight would be added to the end of the tractor opposite the end which is hitched to the backhoe and whenever a counterweight is added increased tractor cost is a direct result. Additionally, counterweighting adds an unnecessary load to the tractor and causes higher fuel consumption as well as reduced operating efficiency and poorer maneuverability. For example, where substantial counterweighting is added to the tractor, it will be more likely to bog down in poor soil condition areas.

Applicant's earlier U.S. Pat. No. 3,894,641, granted July 15, 1975, disclosed one type of swing mechanism which provided a partial solution to these problems.

It is the principal object of this invention to provide an improved swing mechanism for the turret and boom of earthmoving equipment which substantially eliminates the above described difficulties and provides a mechanism of compact configuration.

It is a further object of this invention to provide a swing mechanism of the above type in which the rotational velocity of the boom throughout a horizontal arc of movement versus the linear velocity of the piston rods of the said rams is maintained at a predetermined ratio.

It is another object of this invention to provide a swing mechanism of the above type in which the boom of the earthmoving apparatus is driven with equal power in both directions throughout a horizontal arc of movement.

A further object of this invention is to provide a swing mechanism in which maximum hydraulic force is utilized in both driving directions throughout the boom's horizontal arc of movement.

The above and other objects and advantages of this invention will be more readily apparent from the following description and with reference to the accompanying drawings, in which.

Figure 1:
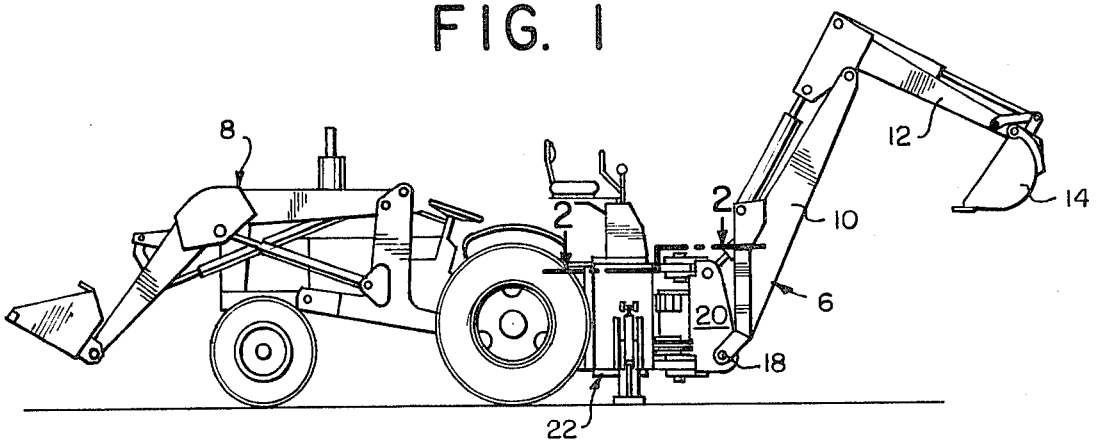
FIG. 1 is an overall elevational view showing a tractor and backhoe utilizing the swing mechanism embodying this invention.

Referring in detail to the drawings, this invention comprises a mechanism for swinging or rotating the turret of a backhoe 6, which is capable of being hitched to a tractor as shown at 8 for hauling the backhoe from place to place.

The backhoe includes a turret 20, boom 10, dipperstick 12 and bucket 14. Boom 10 may be raised and lowered in a vertical arc by a hydraulic ram, the rod of which is shown at 16 is pivotally connected to turret at 17. One end of the boom is connected at 18 to turret 20 permitting pivotal movement of the boom in a vertical plane.

Figure 2:
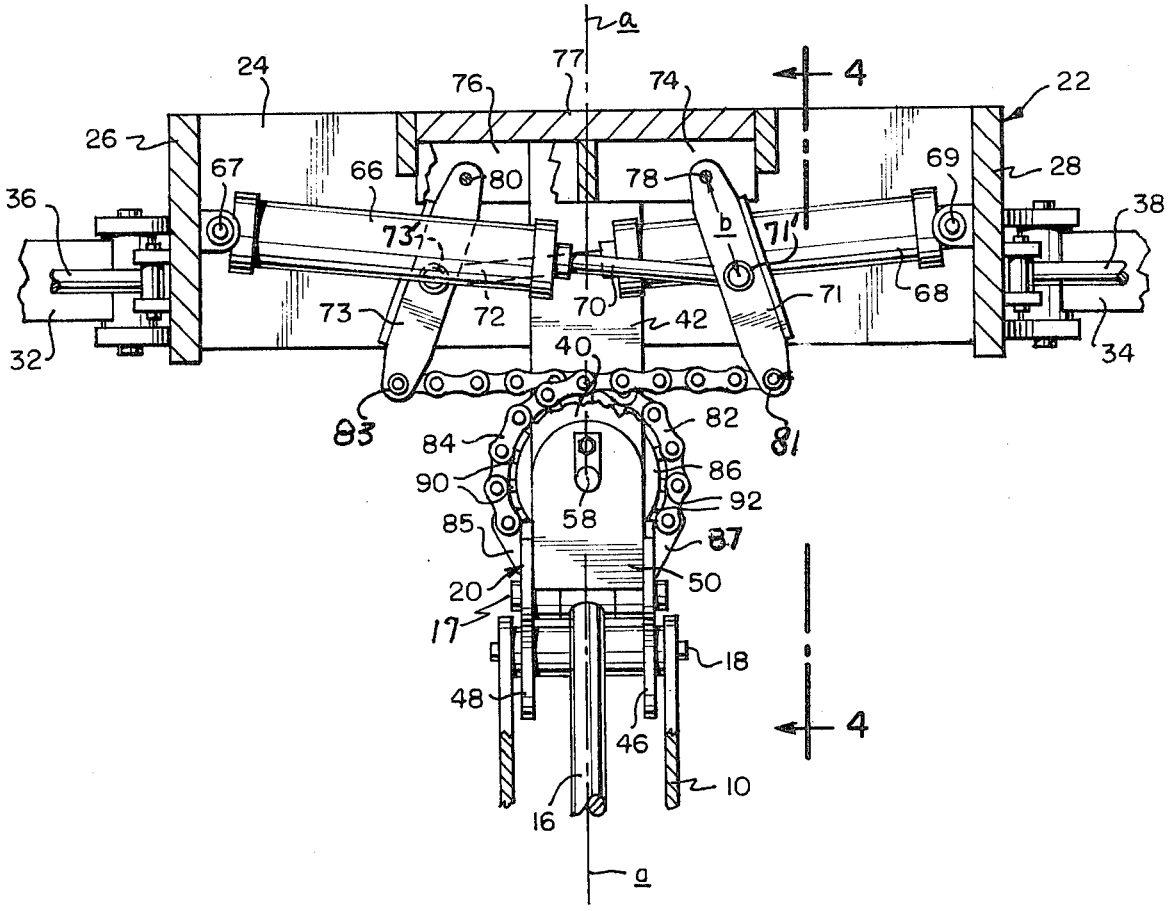
FIG. 2 is a section on an enlarged scale taken along line 2—2 of FIG. 1.
Figure 4:
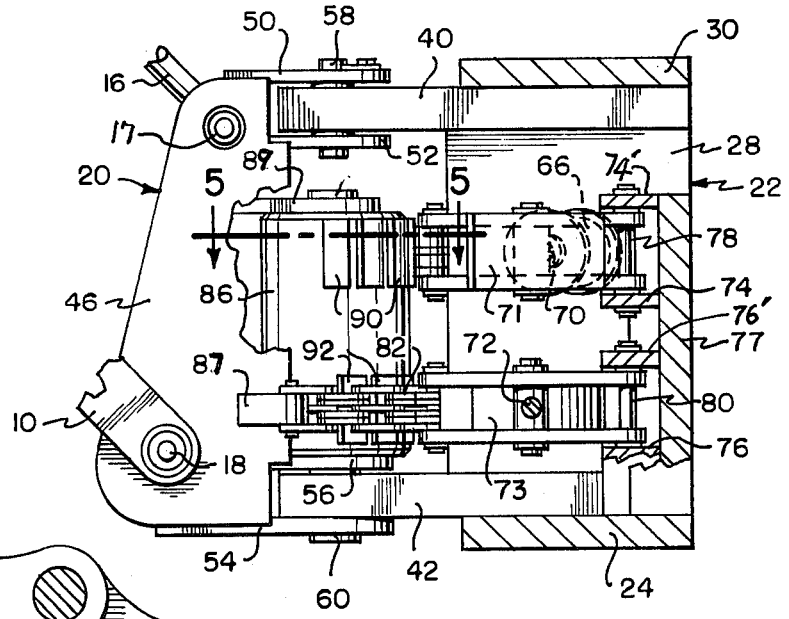
FIG. 4 is a section taken along line 4—4 of FIG. 2.

As best seen in FIGS. 2 and 4, the main or box frame 22 is generally rectangular and comprises a base member or plate 24, upstanding end plates 26 and 28, upright member 77 and a top plate 30, FIG. 4. Stabilizer legs 32 and 34 extend outwardly from opposite sides of the main frame and are pivotably connected to lugs extending from the side walls 26 and 28 of the main frame. Ram members, such as piston rods 36 and 38, are pivotally connected to lugs extending from the main frame and provide means for raising and lowering stabilizer legs 32 and 34. A pair of vertically spaced support members 40 and 42 extend horizontally outwardly of the main frame 22 as shown in FIG. 4 and provide means for pivotably supporting turret or swing frame 20 for substantially horizontal arc of movement.

Turret 20 comprises a pair of spaced upright plate members 46 and 48, affixed adjacent their upper and lower ends are two pairs of spaced brackets 50 and 52 at the upper end and 54 and 56 at the lower end. Pins 58 and 60 extend vertically through the support members 40 and 42 and through both pairs of said brackets whereby turret 20 is horizontally pivotable as shown in FIG. 4.

Drum or arcuate member 86 forms part of turret 20 and is rotatable therewith. Said drum is secured to vertically spaced plates 56 and 89 with its axis substantially coaxial with vertical pivots 58 and 60 of said turret as best seen in FIG. 4.

Figure 3:
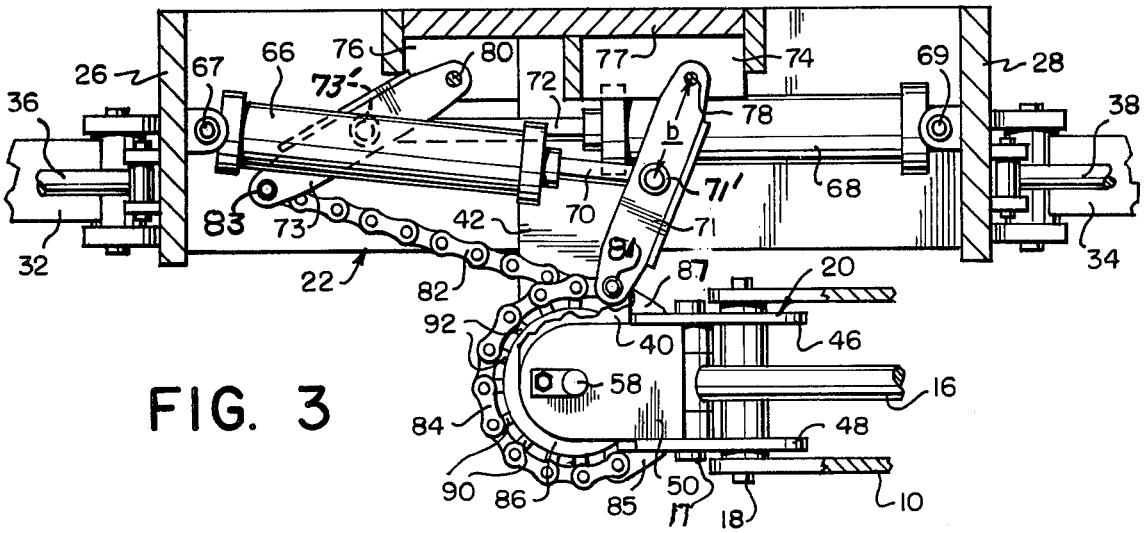
FIG. 3 is a view similar to FIG. 2 with parts thereof in different operative relationship.

Hydraulic drive means is provided to swing or rotate turret 20 and boom 10 which is carried thereby through a horizontal arc or angle of approximately 180° when viewed from above, the boom may be swung approximately 90° to each side of a position as defined by axis *a* if FIG. 2. Axis *a* corresponds to the longitudinal centerline of boom 10 when the boom is located at substantially the center of a horizontal arc of movement when viewed from the top. One extreme position of rotation of the boom is illustrated in FIG. 3.

Drive means for rotating turret 20 comprises a pair of hydraulic rams or cylinders 66 and 68, the closed or outer end of each being pivotably supported for substantially horizontal movement by vertical pivots 67 and 69 and lugs extending from respective end walls 26 and 28 of main frame 22, as shown in FIG. 2. One each of piston rods 70 and 72 extend from the other or rod end of each cylinder and their outer ends are pivotably connected to levers 71 and 73 as shown as 71′ and 73′. One end of lever 71 is pivotably supported by vertically spaced plates 74 and 74′ which are affixed to upright member 77 of the main frame. Said plates 74 and 74′ support the vertical pivot pin 78 on which lever 71 is horizontally pivotable about a point which is laterally spaced from and on one side of axis *a*, as shown in FIG. 2. One end of lever 73 is pivotably supported by vertically spaced plates 76 and 76' which are also affixed to upright member 77 of the main frame. Plates 76 and 76' support vertical pivot pin 80 on which lever 73 is horizontally pivotable about a point is laterally spaced from and on the side of axis *a*, as shown in FIG. 2, opposite that of lever 71. Moreover, lever 71 is disposed for a substantially horizontal arc of movement on one side of said axis *a* when viewed from the top, whereas lever 73 is disposed for a substantially horizontal arc of movement of the opposite side of said axis *a*, as best seen in FIGS. 2 and 3. At its other end, each lever 71 and 73 is pivotably connected as at 81 and 83 to one end of each of an elongate flexible member, which in the embodiment shown, comprises link chains 82 and 84. The other end of each chain 82 and 84 is connected to a boss such as 85 and 87 which are affixed to plates 46 and 48 of turret 20. Each of the chains from their points of connection 81 and 83 to the levers 71 and 73, when viewed from the top as shown in FIG. 2, continue along straight lines in substantially opposite directions to their points of tangential contact with the periphery of an arcuate member which in the embodiment shown is in the form of a drum 86. The elongate flexible members cross each other, when viewed from the top as shown in FIG. 2. From their points of contact with the drum, the chains are partially wound about the periphery of drum 86, as shown in FIG. 2, being free of sheaves to guide the chains. Chain 84 is disposed above chain 82 in vertically spaced relation. Cylinder 66 is disposed directly above lever 73 and cylinder 68 is disposed directly below lever 71. By this vertically stacked arrangement, it will be noted that in the lateral direction cyclinders 66 and 68 and their associated drive mechanisms are partially coextensive within frame 22.

Drum 86 forms part of turret 20 and is rotatable therewith. The drum is secured to vertically spaced plates 56 and 89 which are affixed between plates 46 and 48. Turret 20, including drum 86, is pivotably supported by frame 22 by means of pivot pins 58 and 60 as previously indicated. The center of rotation of turret 20 and the pivot points of levers 71 and 73 define a triangle, the altitude of which is aligned with said axis *a* and is the perpendicular bisector of the side defined by the pivot points of levers 71 and 73.

Ram 66, lever 71, chain 84 and the portion of the drum 86 about which the chain 84 is partially wound during the power or drive stroke of ram 66 comprises one generally coplanar drive means for rotating boom 10 in a cockwise direction when viewed from the top, while lower ram 68, lever 73, chain 82 and the portion of drum 86 about which the chain is wound during the drive stroke of ram 68 constitute the second coplanar drive means for rotating boom 10 counterclockwise. Each cylinder or ram is disposed generally transverse or perpendicular to the said axis *a* which, when viewed from the top, represents the longitudinal centerline of boom 10 when the boom is at the center of a horizontal arc of movement. Moreover, the strokes of piston rods 70 and 72 are generally transverse to the said axis *a* as shown in FIG. 2, whereby these drive mechanisms and their operative movement substantially overlap and are coextensive in the transverse direction when viewed from above as in FIGS. 2 and 3. This vertically stacked arrangement of the swing mechanism components results in a frame of compact configuration both longitudinally and laterally.

The linear movement of piston rods 70 and 72 provided by rams 66 and 68 is converted to horizontal, pivotal or rotational movement of turret 20 by means of pivotable levers 71 and 73, flexible link chains 82 and 84, and the arcuate surface of drum 86 about which the chains extend. Each of the chains 82 and 84 extends in a substantially horizontal plane from its point of connection to each of levers 71 and 73 along straight lines to an initial point of contact with the periphery of the drum 86 when viewed from the top and from this point chains 82 and 84 extend about the drum as shown in FIG. 2, one spaced above the other as shown in FIG. 4. Chains 82 and 84 are connected at their other end to plates 46 and 48 by bosses 85 and 87 as previously indicated.

Pressurized hydraulic fluid on being selectively supplied to the closed or outer end of one ram or cylinder 66 or 68 causes outward movement of the associated piston rod 70 or 72, thereby providing a drive stroke or drive movement of ram or cylinder 66 or 68, as best seen in FIG. 2. As pressurized hydraulic fluid is being supplied to the closed end of one of the cylinders 66 or 68 for the power stroke thereof, fluid is simultaneously exhausted from the closed end of the other cylinder. The power strokes of rams 66 and 68 are generally in opposite directions. Pressurized fluid when selectively supplied to the closed or outer ends of cylinders 66 and 68 acts on the total piston area, not reduced by the presence of a piston rod as is the inner or rod end of cylinders 66 or 68. The effective result is a drive stroke or power stroke of maximum force for any given hydraulic pressure. This force is utilized during the drive stroke of each cylinder for providing horizontal turret rotation in both directions.

The pivotal connection of piston rods 70 and 72 to levers 71 and 73 may be at any suitable distance *b* from pivot pins 78 and 80 as shown in FIGS. 2 and 3. When one cylinder such as 68 is exerting a drive stroke, hydraulic fluid is exhausted by suitable hydraulic control means from the closed or outer end of the other cylinder 66. Lever 73 will thus be swung clockwise and chain 82 which follows the arcuate surface of drum 86 will cause counterclockwise rotation of turret 20 as per FIG. 2. Moreover, when turret 20 is rotated or swung counterclockwise to substantially the limit of its rotational movement as per FIG. 3, the distance from the axis of pivot point 83 to said longitudinal centerline of boom 10 as defined by axis *a* when viewed from the top and shown in FIG. 2 is greater than the distance from the axis of its associated pivot point 80 to said axis *a*, whereas the distance from the axis of pivot point 78 to said axis *a* is greater than the distance from the axis of its associated pivot point 81 to said axis *a*. Moreover, when turret 20 is rotated or swung clockwise to substantially the opposite limit of its rotational movement, the distance from the axis of pivot point 80 to said longitudinal centerline of boom 10 as defined by said axis *a* when viewed from the top and shown in FIG. 2 is greater than the distance from the axis of its associated pivot point 83 to said axis *a*, whereas the distance from the axis of pivot point 81 to said axis *a* is greater than the distance from the axis of its associated pivot 78 to said axis *a*.

The periphery of the drum or arcuate member 86 about which the link chains 82 and 84 extend when being driven by their associated cylinder, is in the nature of a continuously acting lever having its fulcrum located at the axis of drum 86. During the drive stroke of ram 68, chain 84 will cause lever 71 to swing clockwise which results in fluid from the closed or outer end of ram 66 being exhausted. The drive stroke by ram 68 and lever 73 may be continued until boom 10 is rotated or swung about 90° in one direction from its central position, shown in FIG. 2. Boom 10 may be rotated or swung in the opposite direction by supplying pressurized hydraulic fluid to the closed end of cylinder 66, thereby causing rod 70 to move outwardly, thereby causing a drive stroke or drive movement of ram 66, which causes lever 71 to swing counterclockwise with resultant clockwise rotation of turret 20 and the boom carried thereby.

Means is provided to maintain a constant ratio of the angular velocity of boom 10 versus the linear velocity of piston rods 70 and 72 at different horizontal positions throughout the substantially horizontal movement of the boom. This ratio would ordinarily vary as the boom is moved through different angular positions of its horizontal rotational movement by the constant linear movement of piston rods 70 and 72, pivotal movement of levers 71 and 73 and linear movement of chains 82 and 84. The ratio variation results from changes in the various working angles between these mechanisms including the angles defined by the geometric centerlines of piston rods 70 and 72 and the centerlines of levers 71 and 73 throughout the substantially horizontal movement of said levers. Means is provided to compensate for the above described variations of the several components of the swing mechanism embodying this invention.

Figure 5:
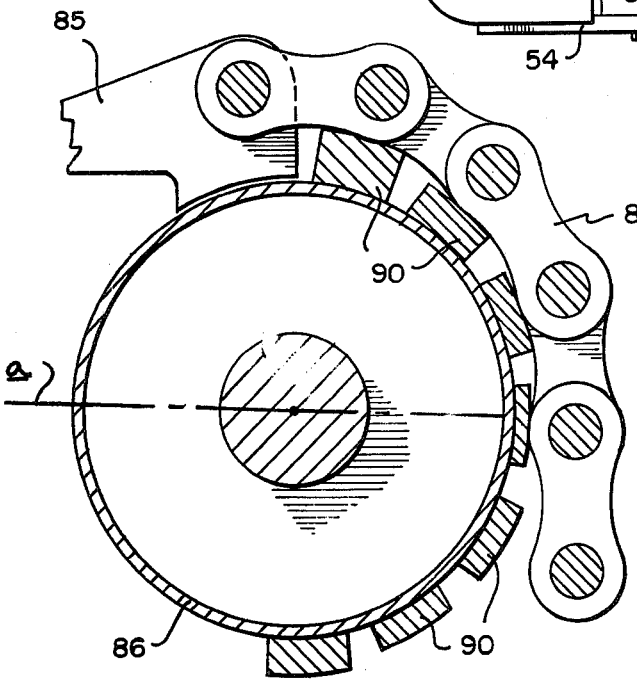
FIG. 5 is a section on an enlarged scale taken along line 5—5 of FIG. 4.

As best seen in FIG. 5, drum 86 is adapted to compensate for the rotational velocity variations in the horizontal movement of boom 10 driven by the constant linear velocity of piston rods 70 and 72. As shown, the radial dimensions of arcuate member 86 are varied at circumferentially spaced locations about the periphery of said arcuate member. One suitable way of readily obtaining this radial variation is by affixing a plurality of shims 90 and 92 of different thickness, measured radially from the axis or center of rotation of arcuate member 86 and arranged circumferentially about the periphery of said arcuate member. The upper row of shims 90 is located in a substantially horizontal plane when viewed from the side which corresponds substantially with the horizontal plane of chain 84. The lower row of shims 92 corresponds generally with the same horizonal plane as chain 82, as shown in FIG. 4. The inner surface of the links which make up the drive chains 82 and 84 engage the outer surface of the respective row of shims 90 and 92, as shown in FIG. 5. In the illustrated embodiment, the variations in said radial dimensions are generally proportional to the magnitude of the variations in rotational or angular velocity of the boom at different rotational positions caused by the constant linear movement of piston rods 70 and 72, pivotal movement of levers 71 and 73 and linear movement of chains 82 and 84. By this arrangement, boom 10 is trained or rotated at a substantially uniform or constant angular velocity consistent with the linear velocity of piston rods 70 and 72 throughout an arc of horizontal movement. That is, the ratio of the angular velocity of the boom versus the linear velocity of the driving pistons is maintained constant.

Alternatively, the convexly curved outer surface of drum 86 about which the flexible chains 82 and 84 extend may be generated to provide a cam surface of any desired curvature to obtain any predetermined ratio of the angular velocity of turret 20 at different horizontally rotational positions of boom 10 versus the linear velocity of the piston rods 70 and 72. For example, it may be desirable to reduce the angular velocity of said boom near its extreme limits of horizontal movement without reducing the linear velocity of piston rods 70 and 72, so as to reduce its momentum prior to stopping said boom.

Having thus described my invention, what is claimed is:

1. Swing mechanism for an earthmoving apparatus such as a backhoe and the like comprising a main frame, a turret carrying a boom and being pivotally supported by said frame for rotation through a substantially horizontal arc of movement, said turret including an arcuate member rotatable therewith, means for rotating said turret including a pair of hydraulic rams one end of each pivotally supported by said frame, means for selectively supplying pressurized hydraulic fluid to one end of said rams for the power stroke thereof and for simultaneously exhausting fluid from the other of said rams, piston rods extending from the other ends of said rams, a pair of levers one end of each pivotally supported by said main frame, one of said piston rods being pivotally connected to one of said levers, the other of said piston rods being pivotally connected to the other of said levers to rotate said levers independently through a substantially horizontal arc of movement during the drive strokes of said rams, a pair of elongate flexible members each having one end pivotally connected to one each of the other ends of said levers, the other end of each of said elongate flexible members being connected to said turret, both said elongate flexible members operating in tensioned condition during rotational movement of the turret by hydraulic fluid pressure in both said rams, portions of said elongate flexible members extending at least partially around the periphery of said arcuate member during the drive strokes of said rams linked in driving relation with said elongate flexible members, levers and turret whereby pivotal movement of said levers during the drive strokes of said rams causes rotational movement of said turret.

2. Swing mechanism for an earthmoving apparatus such as a backhoe and the like as set forth in claim 1 in which each of said rams has a drive stroke in one direction and a return stroke in the opposite direction, the drive strokes of said rams causing substantially horizontal turret rotation in opposite rotational directions, both said drive strokes having maximum force for any given hydraulic pressure.

3. Swing mechanism for an earthmoving apparatus and the like as set forth in claim 1 in which said rams are disposed so that movement of the piston rods is generally transverse to the longitudinal centerline of the boom, when viewed from the top and when the boom is substantially at the center of a horizontal arc of movement.

4. Swing mechanism for an earthmoving apparatus and the like as set forth in claim 1 in which said arcuate member includes a convexly curved peripheral surface disposed to be engaged by said flexible members when transmitting a driving force to said turret, the length of radial dimension of said arcuate member from its axis to the points of engagement with said flexible members varies at circumferentially spaced locations about the periphery of said arcuate member.

5. Swing mechanism for an earthmoving apparatus and the like as set forth in claim 1 in which the drive stroke of one said ram transmitted to said turret by one of said levers and flexible members causes the return stroke of the other said ram by following movement of the other said flexible member and the said pivotable lever moved thereby.

6. Swing mechanism for an earthmoving apparatus and the like as set forth in claim 1 in which one end of one of said levers is pivotally supported by said main frame, at a laterally spaced point on one side of the longitudinal centerline of the boom when the boom is substantially at the center of a horizontal arc of movement and when viewed from the top, one end of the other of said levers is pivotally supported by said main frame at a point laterally spaced on the opposite side of the said longitudinal centerline of the boom, whereby one of said levers having an arc of movement on one side of said longitudinal centerline of the boom the other of said levers having an arc of movement on the opposite side of said longitudinal centerline of said boom.

7. Swing mechanism for an earthmoving apparatus and the like as set forth in claim 1, in which the longitudinal centerline of one set of said rams, pivotable levers and elongate flexible members which are connected together in driving relation is generally disposed in one horizontal plane when viewed from the side, the longitudinal centerline of the second set of said rams, pivotable levers and elongate flexible members which are connected together in driving relation is generally disposed in a plane spaced vertically in relation to the first said plane.

8. Swing mechanism for an earthmoving apparatus and the like as set forth in claim 1, in which the points at which said levers are pivotally supported by said main frame and the center of rotation of said turret define a triangle whose altitude is aligned with the centerline of said boom when the boom is substantially at the center of a horizontal arc of movement, said altitude being the perpendicular bisector of the side of said triangle defined by the pivot points of said levers.

9. Swing mechanism for an earthmoving apparatus and the like as set forth in claim 1, wherein one end of one lever is pivotally connected at a first point of locality to said main frame which point of connection is spaced laterally from the longitudinal centerline of the boom when the boom is substantially at the center of a horizontal arc of swing movement when viewed from the top, the other end of said lever is pivotally connected at a second point of locality to one end of one of said elongate flexible members, the other end of said elongate member is connected to one side of said turret, one end of the second lever is pivotally connected at a third point of locality to said main frame which point of said connection is spaced laterally from and on the opposite side of said longitudinal centerline of the boom, the other end of said second lever is pivotally connected at a fourth point of locality to one end of second said elongate flexible member of which the other end is connected to the opposite side of said turret, whereby when said turret is rotated to substantially the limit of a rotational arc of movement in one direction, the distance from the axis of the pivot at said second point of locality to said longitudinal centerline of the boom when the boom is substantially at the center of a horizontal arc of movement is greater than the distance from the axis of the pivot at said first point of locality to said longitudinal centerline of the boom, whereas the distance from the axis of the pivot at said third point of locality to said longitudinal centerline of the boom is greater than the distance from the axis of the pivot at said fourth point of locality to said longitudinal centerline of the boom, when said turret is rotated in the opposite direction to substantially the limit of a rotational arc of movement the distance from the axis of the pivot at said first point of locality to said longitudinal centerline of the boom when the boom is substantially at the center of a horizontal arc of movement is greater than the distance from the axis of the pivot at said second point of locality to said longitudinal centerline of the boom, whereas the distance from the axis of the pivot at said fourth point of locality to said longitudinal centerline of the boom is greater than the distance from the axis of the pivot at said third point of locality to said longitudinal centerline of the boom.

10. Swing mechanism for an earthmoving apparatus such as a backhoe and the like as set forth in claim 1 in which one set of interconnected drive mechanisms including one each of said rams, piston rods and pivotable levers is at least partially coextensive in a transverse direction with respect to the longitudinal centerline of the boom and when viewed from the top, when the boom is substantially at the center of a horizontal arc of movement, with the other set of interconnected drive mechanisms including one each of the other said rams, piston rods and pivotable levers.

11. Swing mechanism for an earthmoving apparatus such as a backhoe and the like as set forth in claim 1 in which said flexible members extend in substantially opposite directions along straight lines from their points of connection to said pivotable levers to points of engagement with the periphery of said arcuate member and cross each other when viewed from the top.

12. Swing mechanism for earthmoving apparatus such as a backhoe and the like as set forth in claim 1 in which said elongate flexible members extending at least partially about the periphery of said arcuate member are free of sheaves to guide said elongate flexible members.

* * * * *